US011634928B2

(12) United States Patent
Lin

(10) Patent No.: US 11,634,928 B2
(45) Date of Patent: Apr. 25, 2023

(54) FENCING ASSEMBLY

(71) Applicant: Tiao Chin Lin, Changhua County (TW)

(72) Inventor: Tiao Chin Lin, Changhua County (TW)

( * ) Notice: Subject to any disclaimer, the term of this patent is extended or adjusted under 35 U.S.C. 154(b) by 162 days.

(21) Appl. No.: 17/320,254

(22) Filed: May 14, 2021

(65) Prior Publication Data

US 2022/0364384 A1 Nov. 17, 2022

(51) Int. Cl.
*E04H 17/22* (2006.01)
*E04H 17/14* (2006.01)

(52) U.S. Cl.
CPC ..... *E04H 17/22* (2013.01); *E04H 17/1439* (2013.01); *E04H 17/1478* (2021.01)

(58) Field of Classification Search
CPC ..... E04H 17/009; E04H 17/20; E04H 17/21; E04H 17/22; E04H 17/1417; E04H 17/1426; E04H 17/1439; E04H 17/1478; E04H 12/22; E04H 12/2253; E04H 12/2269; E04H 12/2276; E04F 2011/1823; E04F 2011/1825; E04F 2011/1827; E04F 11/1846
See application file for complete search history.

(56) References Cited

U.S. PATENT DOCUMENTS 4,014,520 A * 3/1977 Walters ..... E04F 11/1817 256/22
4,403,767 A * 9/1983 Basey ..... E04F 11/1834 403/294
4,907,907 A * 3/1990 Kreusel ..... E04B 1/1906 403/312
6,082,070 A * 7/2000 Jen ..... E04H 12/2253 403/217
6,520,704 B1 * 2/2003 Vidmar ..... F16B 35/06 403/279
6,889,960 B1 * 5/2005 Jones ..... E04F 11/1817 411/510
6,932,329 B1 * 8/2005 Harder ..... E04F 11/1834 256/65.01
7,762,533 B2 * 7/2010 DeRogatis ..... E04F 11/181 256/22
9,212,676 B2 * 12/2015 Selle ..... F16B 21/084
9,556,641 B2 * 1/2017 Milanowski ..... E04F 11/1842
9,790,689 B2 * 10/2017 Milanowski ..... E04F 11/1842
10,060,136 B2 * 8/2018 Milanowski ..... E04F 11/1817
10,344,483 B2 * 7/2019 Yu ..... E04F 11/1846
(Continued)

*Primary Examiner* — Jonathan P Masinick

(57) ABSTRACT

A fencing assembly has two rails, multiple balusters, and multiple positioning assemblies. The two rails are disposed at a spaced interval, and each rail is hollow. Each one of the balusters is hollow and has two ends, wherein each one of the two ends is detachably mounted with a respective one of the two rails. Each one of the positioning assemblies is mounted with a respective one of the two rails and a respective one of the balusters, and has a positioning component and an anti-slip sheath. The positioning component is mounted with the corresponding rail, and has at least one stopping flange protruding radially. The anti-slip sheath is inserted into an end of the corresponding baluster and is sheathed on the positioning component, and at least part of the stopping flange abuts on an inner surface of the anti-slip sheath.

6 Claims, 5 Drawing Sheets

(56) References Cited

U.S. PATENT DOCUMENTS

| | | | | |
|---|---|---|---|---|
| 2006/0107613 | A1* | 5/2006 | Chung | E04F 11/1853 52/832 |
| 2009/0321704 | A1* | 12/2009 | Chung | E04H 12/2253 256/65.14 |
| 2015/0252570 | A1* | 9/2015 | Springborn | E04H 17/1417 52/832 |
| 2016/0298357 | A1* | 10/2016 | Liu | E04H 17/1417 |
| 2020/0040587 | A1* | 2/2020 | Yu | E04F 11/1812 |

* cited by examiner

FENCING ASSEMBLY

BACKGROUND OF THE INVENTION

1. Field of the Invention

The present invention relates to a fence, and more particularly to a fencing assembly that is detachable and reassemble.

2. Description of Related Art

A conventional fence is used for encompassing a certain area and isolating the area from others, and the conventional fence is often installed on a construction site, a garden in front of a house, a kindergarten, or the like, where the encompassed area is private and needs safeguards. The conventional fence has multiple posts standing parallelly and multiple fencing assemblies, wherein each fencing assembly is mounted between two adjacent said posts. Each fencing assembly has two rails disposed horizontally at a spaced interval and multiple balusters. Two ends of each baluster are fixed to the two rails, respectively, and the balusters are parallel to each other.

However, the conventional fence has the following shortcomings.

1. When a user attempts to relocate the conventional fence, the user must detach the fencing assemblies and the posts. However, the balusters are fixed to the two rails, which renders each fencing assembly an undetachable one-piece structure. Consequently, each fencing assembly is hard for handling during transport and is very space-consuming. The number of the conventional fences that can be transported for one single trip is also limited, and the transportation cost is thereby increased.

2. If the user wants to paint the multiple balusters into different colors, he will probably spray over several balusters while only one of them is the user's target. Eventually, the color of the final product will not match the user's expectation.

SUMMARY OF THE INVENTION

The main objective of the present invention is to provide a fencing assembly whose structural technical features eliminate the problems of the conventional fence.

The fencing assembly in accordance with the present invention has two rails, multiple balusters, and multiple positioning assemblies. The two rails are disposed at a spaced interval, and each one of the two rails is hollow. Each one of the multiple balusters is hollow and has two ends, wherein each one of the two ends is detachably mounted with a respective one of the two rails. Each one of the multiple positioning assemblies is mounted with a respective one of the two rails and a respective one of the multiple balusters, and has a positioning component and an anti-slip sheath. The positioning component is mounted with the corresponding rail, and has at least one stopping flange protruding radially. The anti-slip sheath is inserted into an end of the corresponding baluster and is sheathed on the positioning component, and at least part of said stopping flange abuts on an inner surface of the anti-slip sheath.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
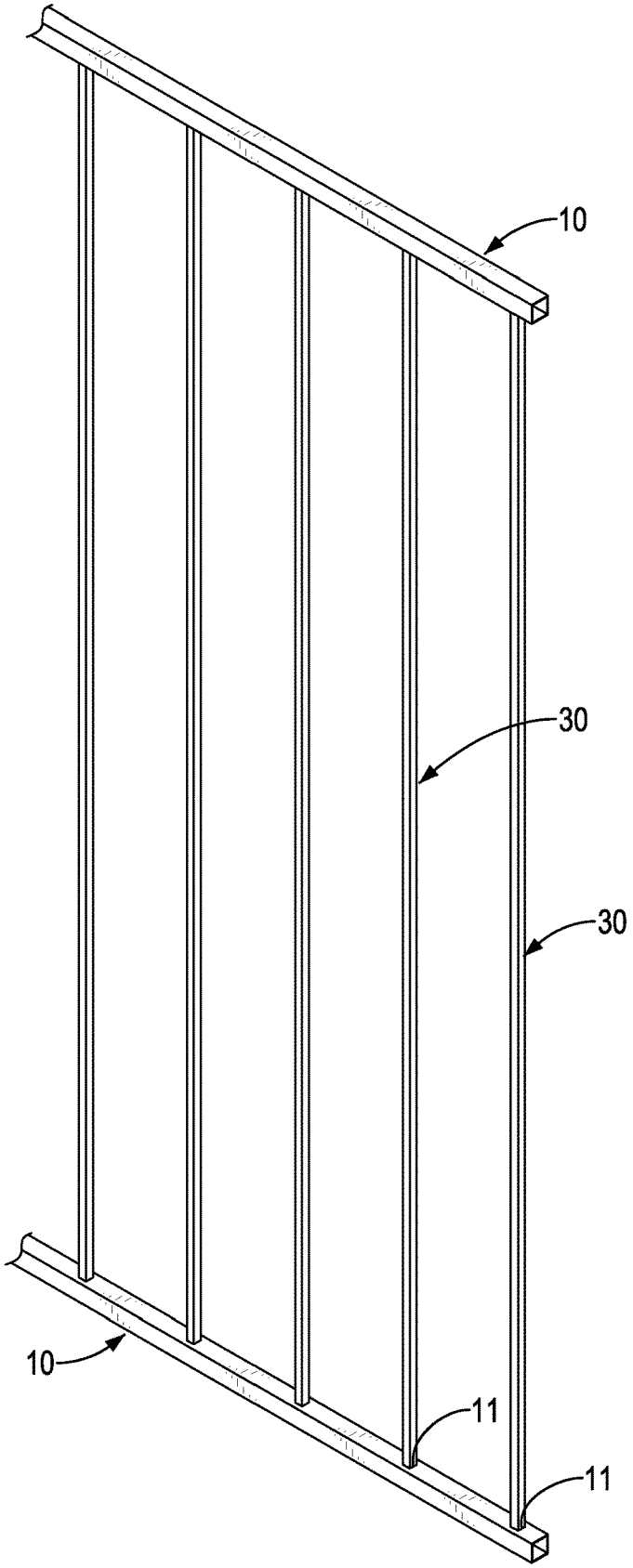
FIG. 1 is a perspective view of a part of a fencing assembly in accordance with the present invention.
Figure 2:
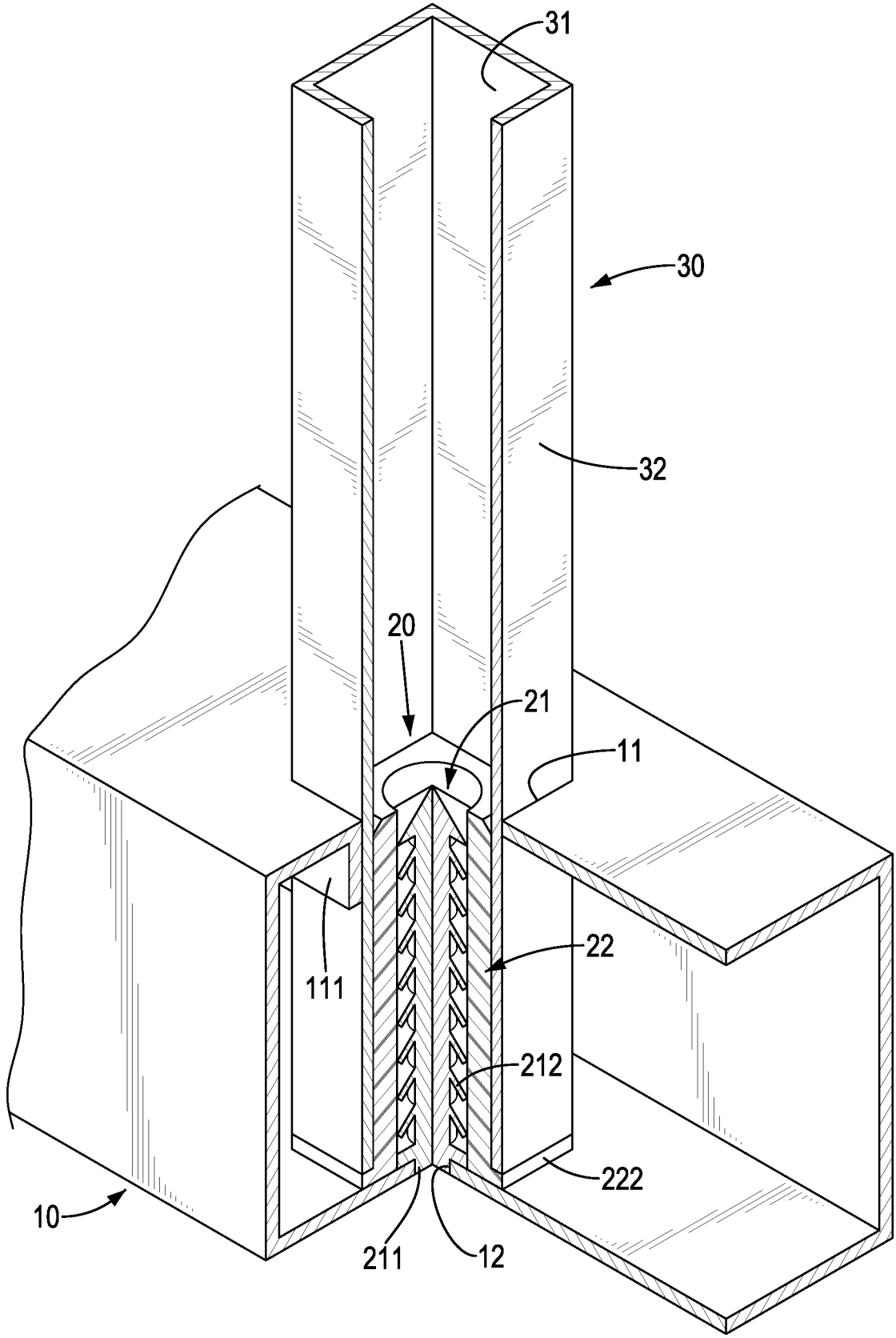
FIG. 2 is an enlarged perspective view in partial section of the fencing assembly in FIG. 1.
Figure 3:
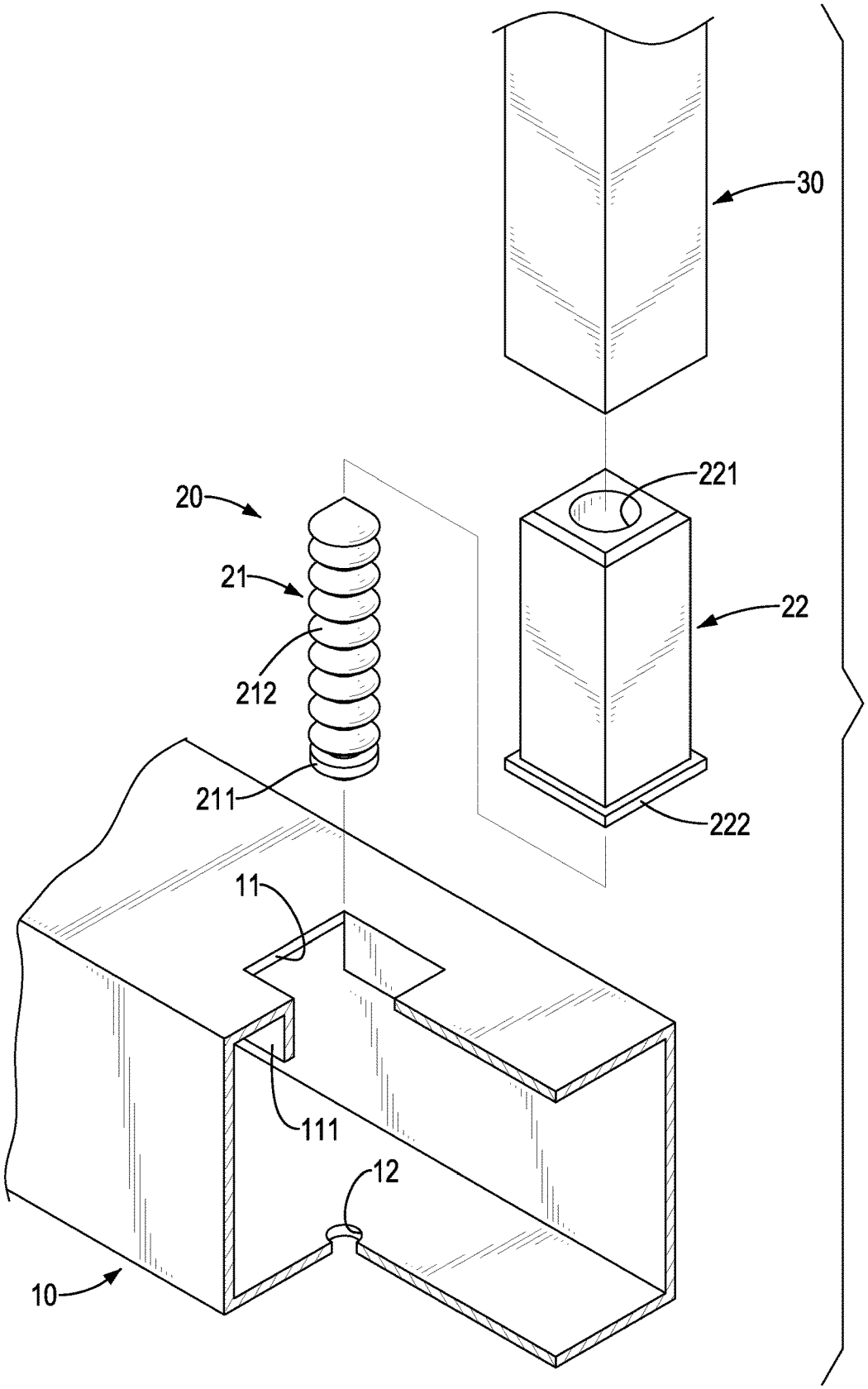
FIG. 3 is an enlarged exploded view of the fencing assembly in FIG. 1, with a rail thereof shown in partial section.
Figure 4:
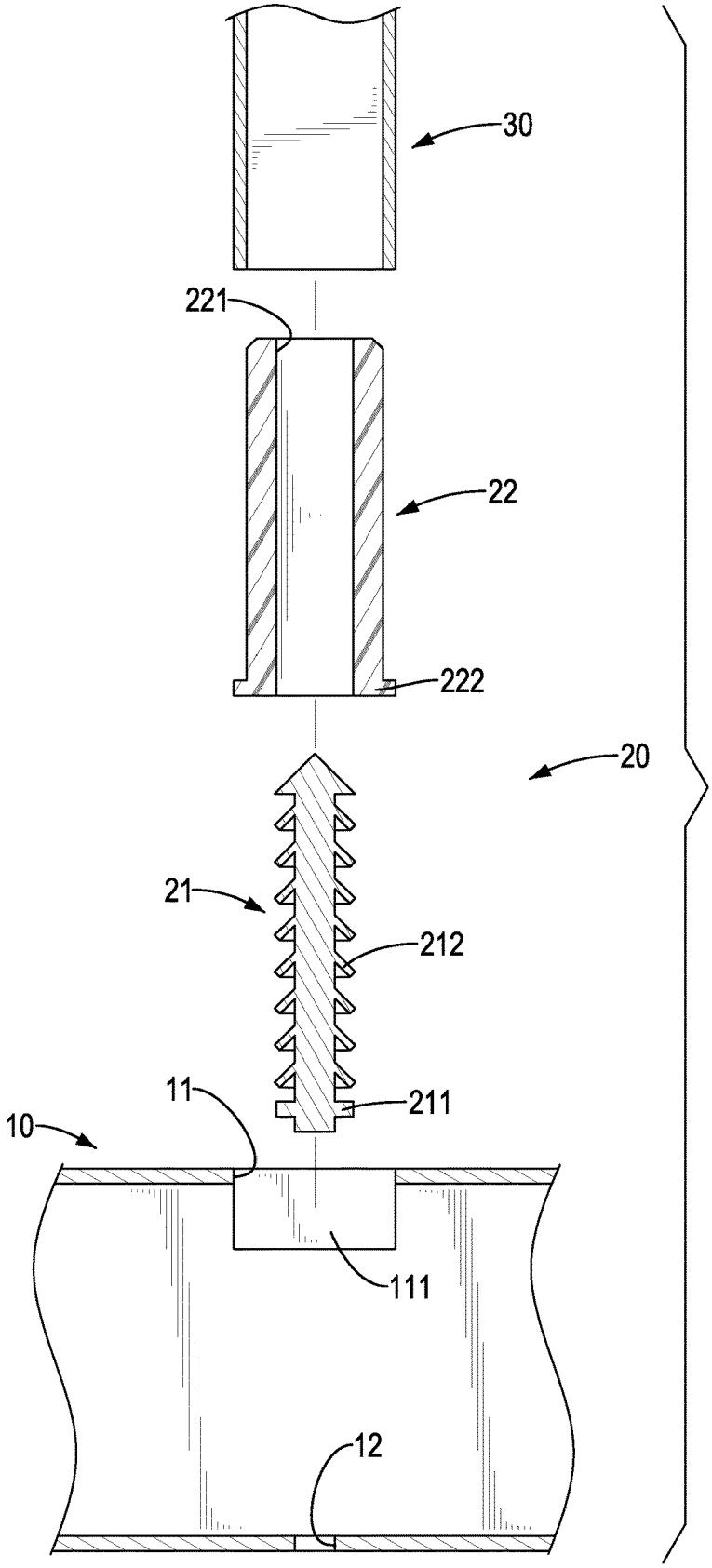
FIG. 4 is an enlarged, exploded, and cross-sectional side view of the fencing assembly in FIG. 1.

With reference to FIGS. 1 and 2, the fencing assembly in accordance with the present invention comprises two rails 10, multiple balusters 30, and multiple positioning assemblies 20.

With reference to FIG. 1, the two rails 10 are parallel to each other at a spaced interval, and each one of the two rails 10 is a hollow structure. With reference to FIGS. 1 to 4, each rail 10 has multiple baluster inserting holes 11, multiple guiding plates 111, and multiple through holes 12. The multiple baluster inserting holes 11 are disposed through the rail 10 at spaced intervals. Each one of the multiple guiding plates 111 is connected with and extends from an inner edge of a respective one of the multiple baluster inserting holes 11, and the inner edge of each one of the baluster inserting holes 11 is connected with at least one of the guiding plates 111. In the preferred embodiment of the present invention, the inner edge of each baluster inserting hole 11 is connected with two of the multiple guiding plates 111, and the two guiding plates 111 are disposed at a spaced interval. The multiple through holes 12 are disposed through the rail 10 at spaced intervals, and moreover, each through hole 12 is aligned with a respective one of the multiple baluster inserting holes 11.

Figure 5:
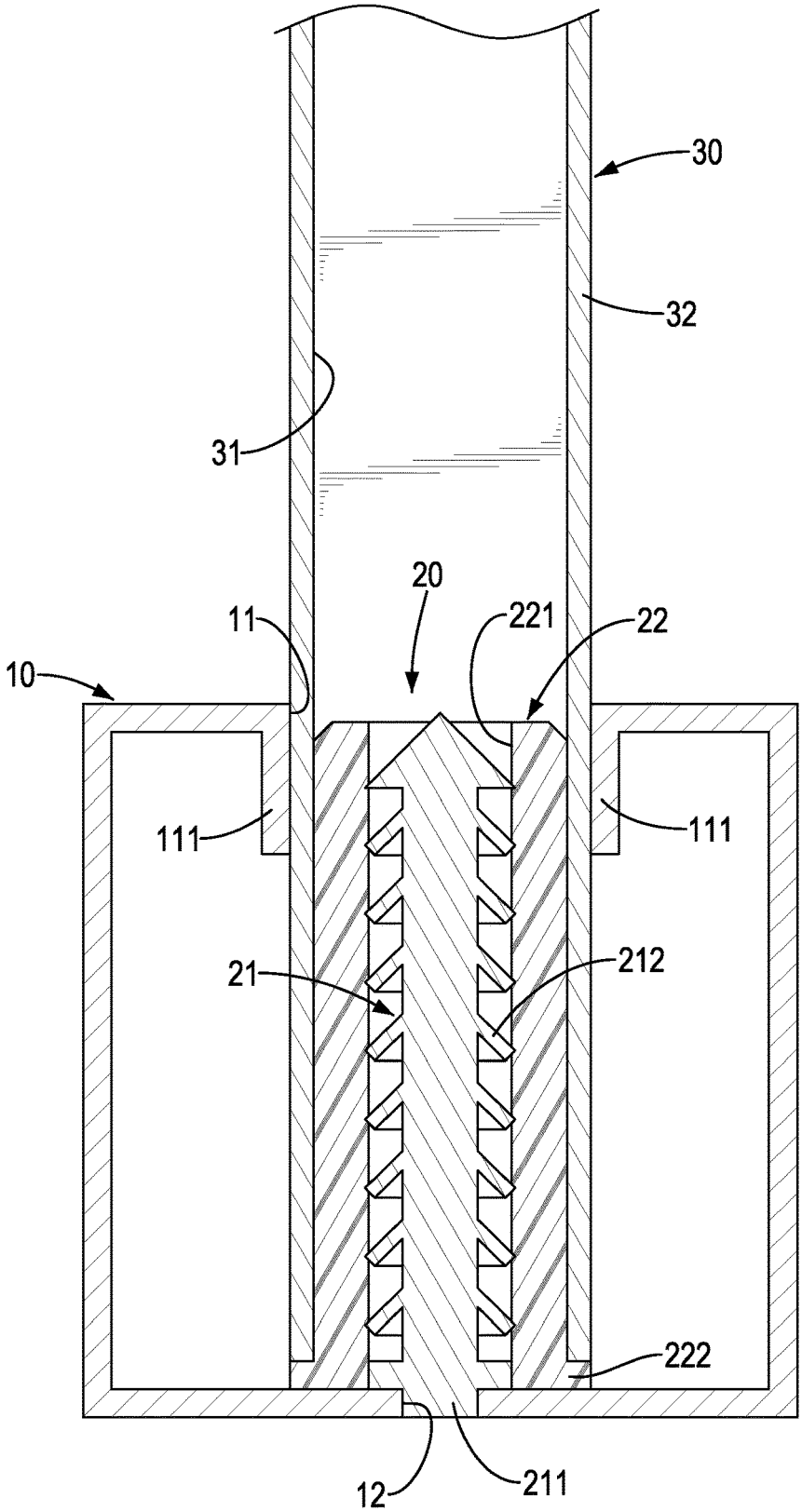
FIG. 5 is an enlarged cross-sectional side view of the fencing assembly in FIG. 1.

With reference to FIGS. 1, 2, and 5, each one of the multiple balusters 30 is hollow, and each one of two ends of each baluster 30 is detachably mounted with a respective one of the two rails 10. Specifically, each end of each baluster 30 is inserted into a respective one of the multiple baluster inserting holes 111 of the corresponding rail 10. The at least one guiding plate 111 connected with the corresponding baluster inserting hole 11 abuts on an outer surface 32 of the baluster 30. In the preferred embodiment of the present invention, both of the two guiding plates 111 of the corresponding baluster inserting hole 11 abut on the outer surface 32 of the baluster 30.

With reference to FIGS. 2 to 5, each one of the multiple positioning assemblies 20 is mounted with a respective one of the two rails 10 and a respective one of the multiple balusters 30, and has a positioning component 21 and an anti-slip sheath 22. The positioning component 21 is mounted with the corresponding rail 10 and has a base 211 and at least one stopping flange 212. The base 211 is formed on one of two ends of the positioning component 21, is configured to fit into a respective one of the multiple through holes 12, and is welded to the corresponding through hole 12. The at least one stopping flange 212 radially protrudes from the positioning component 21 at a position different to that of the base 211. Further, the at least one stopping flange 212 obliquely extends in a direction away from the rail 10 other than the rail 10 that is mounted with the positioning component 20, and forms an inverted V-shaped configuration as shown in FIG. 5. Besides, the at least one stopping flange 212 is located between the corresponding baluster inserting hole 11 and the corresponding through hole 12 of the corresponding rail 10.

In the preferred embodiment of the present invention, each positioning component 21 has multiple said stopping flanges 212 which protrude from the positioning component 21 at spaced intervals. One or more of the multiple stopping flanges 212 may be located within the two guiding plates 111 which are connected with the corresponding baluster inserting hole 11. Each one of the stopping flanges 212 is made of a metallic material, is upwardly tapered, and is configured with a circular contour.

In other possible designs, the at least one stopping flange 212 may extend in an opposite direction to form a V-shaped configuration. Each positioning component 21 may extend beyond the corresponding baluster inserting hole 11, and the at least one stopping flange 212 is exposed outside the corresponding rail 10.

With reference to FIGS. 2 to 5, the anti-slip sheath 22 is inserted into an end of the corresponding baluster 30 and is sheathed on the positioning component 21. The anti-slip sheath 22 has an accommodating groove 221 and a stepped flange 222. The accommodating groove 221 is disposed through the anti-slip sheath 22. The stepped flange 222 radially protrudes from an end of the anti-slip sheath 22, and abuts on the corresponding end of the corresponding baluster 30.

In the preferred embodiment of the present invention, the anti-slip sheath 22 is tightly fit with the corresponding baluster 30, and is made of a plastic material. The accommodating groove 221 has a circular shape, and the at least one stopping flange 212 also has a circular contour. The compatible shapes of the accommodating groove 221 and the at least one stopping flange 212 facilitates the at least one stopping flange 212 to abut an inner surface of the corresponding anti-slip sheath 22 in a closed loop. The positioning component 21 of each positioning assembly 20 can easily pass through the accommodating groove 221 of the anti-slip sheath 22 due to the upward-tapering configuration of the at least one stopping flange 212.

In other embodiments, the shapes of the accommodating groove 221 and the at least one stopping flange 212 may not be complementary to each other, and only part of the at least one stopping flange 212 would abut on an inner surface of the anti-slip sheath 22. Furthermore, each baluster 30 may also be mounted with only one positioning assembly 20 at one of the two ends of the baluster 30. Such configuration is also within the scope of protection of the present invention.

With reference to FIG. 1, in the preferred embodiment of the present invention, the two rails 10 are horizontally arranged, and the multiple balusters 30 are connected therebetween vertically. However, if a fencing assembly, whose structural features are substantially the same with the present invention, is merely rotated by 90 degrees (i.e. the rails 10 are vertical and the balusters 30 are horizontal), such fencing assembly should be still equivalent of the present invention.

With reference to FIG. 5, the at least one stopping flange 212 of each positioning component 21 obliquely extends away from the other rail 10 and abuts on the inner surface of the accommodating groove 221 of the corresponding anti-slip sheath 22, and each anti-slip sheath 22 is mounted with the corresponding baluster 30 on one of the two ends thereof. Hence, when each baluster 30 bears a force extracting the baluster 30 from the corresponding rail 10, the at least one stopping flange 212 may provide a resistant force toward the inner surface of the accommodating groove 221 of the corresponding anti-slip sheath 22, so as to keep the baluster 30 stably mounted between the two rails 10.

Besides, the two guiding plates 111 on each baluster inserting hole 11 may also provide frictional forces against the outer surface 32 of the corresponding baluster 30 as an assistant to prevent the corresponding baluster 30 from being extracted. Also, the two guiding plates 111 inwardly push the baluster 30, and an inner surface 31 of the baluster 30 is outwardly withstood by the stopping flanges 212 located within the two guiding plates 111. By cooperation of the two guiding plates 111 and the stopping flanges 212 therein, the baluster 30 is well fixed and is hard to be removed from the two rails 10.

With the aforementioned technical characteristics, the fencing assembly of the present invention has the following advantages.

1. Contrary to the conventional fencing assembly with an undetachable one-piece structure, the multiple balusters 30 are detachably mounted with the two rails 10. When a user is trying to transport the fencing assembly of the present invention, the user can remove the balusters 30 from the two rails 10. So the disassembled balusters 30 and the two rails 10 are easy for transportation and are space-saving. Transportable capacity for one single transport is increased, and total cost for transportations is thereby reduced.

2. Contrary to that the multiple balusters of the conventional fencing assembly are fixed to the two rails, because the balusters 30 of the present invention can be solely separated, the user may conveniently paint each baluster 30 with different colors. After finishing painting, the user may reassemble the balusters 30 and the rails 10, so the fencing assembly of the present invention appears more colorful and aesthetically attractive.

3. At least one of two ends of each baluster 30 is sheathed on a respective one of the positioning assemblies 20. Due to the extending direction of the at least one stopping flange 212 of each positioning component 21 and the contact of said stopping flange 212 with the corresponding anti-slip sheath 22, said stopping flange 212 may provide the aforementioned opposite resistant force to keep the corresponding baluster 30 stably inserted in the two rails 10 when the baluster 30 is being extracted.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A fencing assembly comprising:

two rails disposed at a spaced interval, and each one of the two rails being hollow;

multiple balusters, each one of the multiple balusters being hollow and having two ends, each one of the two ends detachably mounted with a respective One of the two rails, each one of the two rails having multiple baluster inserting holes disposed at spaced intervals;

multiple guiding plates, an inner edge of each baluster inserting hole connected with at least one of the multiple guiding plates, each one of the two ends of each one of the multiple balusters inserted into a respective one of the multiple baluster inserting holes of the corresponding rail, said at least one guiding plate connected with the baluster inserting hole abutting on an outer surface of the baluster, the inner edge of each one of the multiple baluster inserting holes connected with two of the multiple guiding plates, said two guiding plates disposed at a spaced interval and abutting on the outer surface of the corresponding baluster;

multiple positioning assemblies, each one of the multiple positioning assemblies mounted with a respective one of the two rails and a respective one of the multiple balusters and having a positioning component mounted with the corresponding rail and having at least one stopping flange protruding radially, the at least one stopping flange of each one of the positioning components of the positioning assemblies located between the two guiding plates in the corresponding baluster inserting hole of the corresponding rail, and an anti-slip sheath inserted into one of the two ends of the corresponding baluster and sheathed on the positioning component, wherein at least part of said stopping flange abuts on an inner surface of the anti-slip sheath.

2. The fencing assembly as claimed in claim 1, wherein the at least one stopping flange of each one of the positioning components of the multiple positioning assemblies abuts an inner surface of the corresponding anti-slip sheath in closed loop.

3. A fencing assembly comprising:

two rails disposed at a spaced interval, and each one of the two rails being hollow;

multiple balusters, each one of the multiple balusters being hollow and having two ends, each one of the two ends detachably mounted with a respective one of the two rails;

multiple positioning assemblies, each one of the multiple positioning assemblies mounted with a respective one of the two rails and a respective one of the multiple balusters and having a positioning component mounted with the corresponding rail and having at least one stopping flange protruding radially, the at least one stopping flange of each one of the positioning components of the multiple positioning assemblies obliquely extending in a direction away from the rail other than the rail that is mounted with the positioning component, each one of the two rails having multiple baluster inserting holes disposed at spaced intervals, and multiple guiding plates, an inner edge of each baluster inserting hole connected with at least one of the multiple guiding plates, each one of the two ends of each one of the multiple balusters inserted into a respective one of the multiple baluster inserting holes of the corresponding rail, said at least one guiding plate connected with the baluster inserting hole abutting on an outer surface of the baluster, the inner edge of each one of the multiple baluster inserting holes connected with two of the multiple guiding plates, said two guiding plates disposed at a spaced interval and abutting on the outer surface of the corresponding baluster, the at least one stopping flange of each one of the positioning components of the positioning assemblies located between the two guiding plates in the corresponding baluster inserting hole of the corresponding rail, and an anti-slip sheath inserted into one of the two ends of the corresponding baluster and sheathed on the positioning component, wherein at least part of said stopping flange abuts on an inner surface of the anti-slip sheath.

4. The fencing assembly as claimed in claim 3, wherein the at least one stopping flange of each one of the positioning components of the multiple positioning assemblies abuts an inner surface of the corresponding anti-slip sheath in a closed loop.

5. A fencing assembly comprising:

two rails disposed at a spaced interval, and each one of the two rails being hollow;

multiple balusters, each one of the multiple balusters being hollow and having two ends, each one of the two ends detachably mounted with a respective one of the two rails, each one of the two rails having multiple baluster inserting holes disposed at spaced intervals, and multiple guiding plates, an inner edge of each baluster inserting bole connected with at least one of the multiple guiding plates, each one of the two ends of each one of the multiple balusters inserted into a respective one of the multiple baluster inserting holes of the corresponding rail, and said at least one guiding plate connected with the baluster inserting hole abutting on an outer surface of the baluster, the inner edge of each one of the multiple baluster inserting holes connected with two of the multiple guiding plates, and said two guiding plates disposed at a spaced interval and abutting on the outer surface of the corresponding baluster, the at least: one stopping flange of each one of the positioning components of the positioning assemblies located between the two guiding plates in the corresponding baluster inserting hole of the corresponding rail;

multiple positioning assemblies, each one of the multiple positioning assemblies mounted with a respective one of the two rails and a respective one of the multiple balusters and having a positioning component mounted with the corresponding rail and having at least one stopping flange protruding radially, the two ends of each one of the multiple balusters each sheathed on a respective one of the multiple positioning assemblies, and an anti-slip sheath inserted into one of the two ends of the corresponding baluster and sheathed on the positioning component, wherein at least part of said stopping flange abuts on an inner surface of the anti-slip sheath.

6. The fencing assembly as claimed in claim 5, wherein the at least one stopping flange of each one of the positioning components of the multiple positioning assemblies abuts an inner surface of the corresponding anti-slip sheath in a closed loop.

* * * * *